US006454623B1

(12) United States Patent
Flatau

(10) Patent No.: US 6,454,623 B1
(45) Date of Patent: Sep. 24, 2002

(54) RING WING TOY

(76) Inventor: Abraham Flatau, 3330 Vernon Ter., Palo Alto, CA (US) 94303

( * ) Notice: Subject to any disclaimer, the term of this patent is extended or adjusted under 35 U.S.C. 154(b) by 0 days.

(21) Appl. No.: 09/691,785

(22) Filed: Oct. 17, 2000

Related U.S. Application Data

(60) Provisional application No. 60/161,261, filed on Oct. 25, 1999.

(51) Int. Cl.[7] ..... A63H 27/00
(52) U.S. Cl. ..... 446/34; 473/578
(58) Field of Search ..... 446/34, 61; 473/569, 473/578

(56) References Cited

U.S. PATENT DOCUMENTS 1,568,319 A * 1/1926 Cogswell
3,746,334 A * 7/1973 Stubblefield
3,946,519 A * 3/1976 Vadik et al.
4,390,148 A * 6/1983 Cudmore
5,306,191 A * 4/1994 Phillips et al. ..... 446/61
6,048,245 A * 4/2000 Forti et al. ..... 446/61

OTHER PUBLICATIONS

Philip W. Swift, Plane 18, The Great International Paper Airplane Book. Galahad Books New York.

* cited by examiner

*Primary Examiner*—John A. Ricci

(57) ABSTRACT

A throwable or otherwise launchable aerial toy, which provides two relatively closely spaced colinearly aligned ring wings, with the forward ring wing being larger than the rear ring wing connected through a central slender member. The spokes connecting the rear ring wing to the central slender member can be configured in a fin shape to provide additional aerodynamic stability. The central slender member can be configured with a U-joint connection assembly to eliminate flight wobble due to manufacturing variations. The central slender member can also contain a rotating joint to permit the forward and rear wings or aerodynamic members to rotate independent of one another, separately or in combination with the U-joint connection in the same central slender member connection between the forward aerodynamic member assembly and the tail aerodynamic member assembly.

19 Claims, 6 Drawing Sheets

RING WING TOY

PRIOR APPLICATION

This application is a continuation-in-part application of provisional application Ser. No. 60/161,261 filed on Oct. 25, 1999 and claims priority from it.

FIELD OF THE INVENTION

This invention relates to toys, in particular those which are hand thrown, or launched from a device using compressed air, springs, rubber band, or an electro-mechanical means. More particularly this invention relates to ring wing projectiles and more particularly to ring wing projectiles which are used as a sport toy device.

BACKGROUND OF THE INVENTION

There are a variety of flying toys. One group is similar to the American football, except that at one end of the football, a cylindrical rod-like boom extends rearward. Attached to the rear of the boom are a series of fins, which have a large surface area. These fins are intended to act as a stabilizer. One football shape with a rearward boom and fins is known under the trademark name "Vortex." When thrown like a football, that is, with an initial spin or spiral motion about the flight direction and a forward or translational velocity, the large surface area fins produce high resistance to the rotational motion. In the technical field of ballistics this is known as spin decay or spin damping. Such spin damping readily reduces the gyroscopic stability, while the large, thick fins generate additional drag.

A more recent design variant of the Vortex flying football is the "Vortex Mega Spin." This design allows the football-like fore-body to be thrown with spin, while the tail, which is connected through a rotatable coupling to the fore-body (axially fixed, but freely rotatable with respect to the football fore-body long axis), follows along substantially without spinning (considered to be a non-spinning tail). The non-spinning tail has lower drag than the tail of the original "Vortex" football. Nonetheless, both the fixed and non spinning tail designs of the "Vortex" variety footballs have fairly high aerodynamic drag.

A new "Vortex" product called the "Vortex Thunderjet" has recently come on the market. This new product is unlike the conventional "football" shape (see FIG. 1), in that it has a ring airfoil (or ring wing) as its main aerodynamic body (see FIG. 2). However, the new toy uses a set of conventional fins (see FIG. 2) to produce basic stability and directionality. The use of a ring wing is intended to produce lift and low drag, resulting in a flatter (non-ballistic) trajectory and extended range. That is, when properly thrown the new "Vortex Thunderjet" is intended to outperform, i.e., outrange, the conventional plastic football having conventional tail fins at the rear. The use of conventional tail fins at the rear often results in wobbling motion after the "Vortex Thunderjet" "football" is thrown. Wobble increases the drag and thus reduces the maximum range. The prior art designs suffer from the presence of elements which produce wobble and increase drag. It is desirable to produce a design to minimize wobble and drag so that optimum range based on a launched trajectory can be achieved.

SUMMARY OF THE INVENTION

A toy device according to the invention relates to a sport toy device which is hand thrown. This toy device could also be launched from an appropriately designed launcher using compressed air, spring force, rubber band force, or an electromechanical device. The toy device includes two ring wings. The two ring wings are connected to opposite ends of a relatively short center boom (central slender member). A diameter of a forward ring-wing is larger than a diameter of a rear ring wing. Further, the smaller diameter rear ring wing can contain fins within its inner diameter so as to provide additional flight stability to the toy device. The smaller diameter rear ring wing will be referred to as the tail ring wing, while the larger diameter front ring wing will be referred to as the main ring wing.

A device according to the invention achieves a relatively long range when thrown by hand, especially as compared to the current hand thrown sport toy football, advertised as the "Vortex." The aerodynamic ring-wing shaping of a configuration according to the present invention develops lift from both wings along its flight path and, in combination with low drag, results in a relatively flat trajectory with extended range. The tail ring wing provides aerodynamic stability along its flight path, while having much lower drag than the conventional fins utilized on the Vortex football. A ring-wing device according to the present invention, produces less rotational resistance and excellent stability along its flight path axis, when the device is thrown or launched with initial spin, thus retaining more of the initial energy over the course of the flight path, than a similarly thrown prior art device. The two colinearly aligned wings substantially eliminate wobble and enhance flight stability which enables a hand thrown device according to the present invention to achieve longer range than a hand thrown "Vortex" configuration football, and to fly a longer distance than similarly sized prior art sport toy projectile devices.

Additional features and superior characteristics of the present invention will he better understood through the following detailed description in conjunction with the referenced figures.

DETAILED DESCRIPTION

Figure 1:
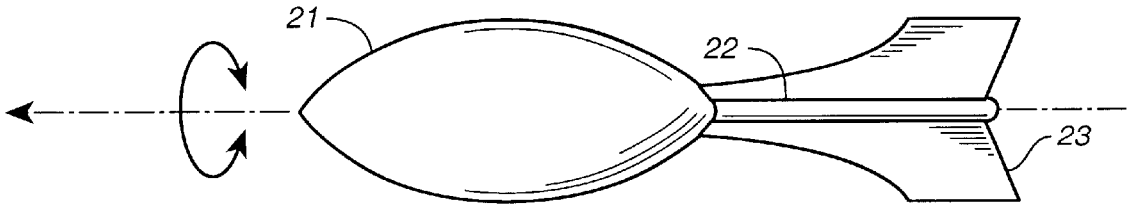
FIG. 1 (PRIOR ART)
FIG. 1 is a side view of the prior art "Vortex" football.

A prior art throwing toy is shown in FIG. 1. It consists of a plastic football shape 21 with a rod or boom (central slender member) 22 extending rearward from the plastic football 21. Also extending rearward and attached to the boom 22 are a series of fixed fins 23 intended to stabilize the plastic football shape 21 in flight. However these large area and thick fins 23 add drag to the plastic football 21 thus requiring a significantly greater initial energy for the toy of FIG. 1 to achieve medium to long range/distance throws when compared to a conventional football.

Figure 2:
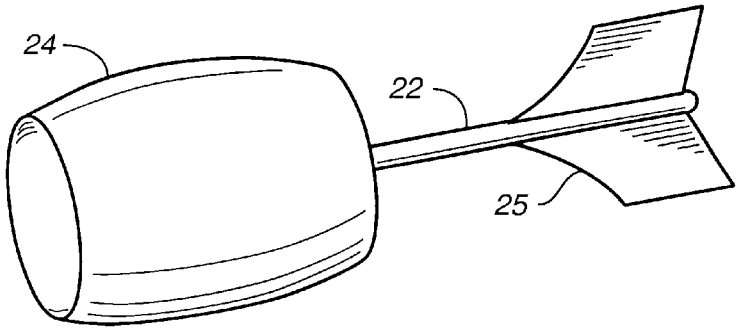
FIG. 2 (PRIOR ART)
FIG. 2 is a perspective view of the prior art "Vortex Thunderjet;"

Consequently, a subsequent prior art design replaced the conventional football shape 21 with a ring wing 24, as shown in FIG. 2. This design has an aerodynamic drag that is less than the drag of the configuration shown in FIG. 1. With the reduced drag the configuration of FIG. 2 can more easily be thrown longer distances with the same initial energy when compared to the travel of the configuration of FIG. 1. However a portion of the potential range is lost because of the drag due to thick fins 25, their thickness is related to the amount of drag they produce, the greater the thickness the greater the drag. Furthermore , the fins act as spin dampers when the toy is thrown with an initial spin. Both elements reduce the efficiency of the design and bleed energy which thereby reduces the range of the throw. In contrast FIG. 3 is a perspective view of a configuration according to the invention.

Figure 3:
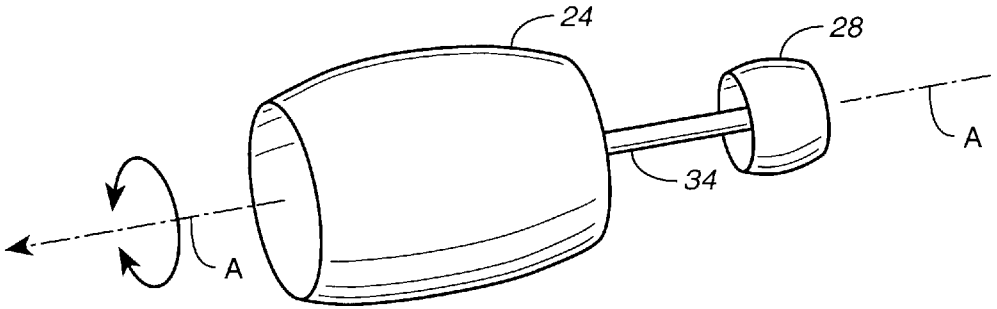
FIG. 3 is a perspective view of a configuration according to the invention.

The configuration shown in FIG. 3 consists of two ring wings 24 and 28, a larger diameter ring 24 (approximately 4" in diameter) serving as the main ring wing, while a smaller diameter ring wing 28 (approximately 3" in diameter) acts as a tail stabilizer. The ratio of the diameter of the tail ring wing to the diameter of the main ring wing can be approximately 0.8:1, 0.75:1, 0.6:1, or 0.5:1.

The main ring and tail stabilizer are connected by a central slender body member (having a nominal diameter of ⅝ inches). The distance between the trailing edge of the main ring wing and the leading edge of the tail ring wing can be a selected ratio of the diameter of the main wing, such as 3:1, 2:1, and 1.5:1.

Figure 4:
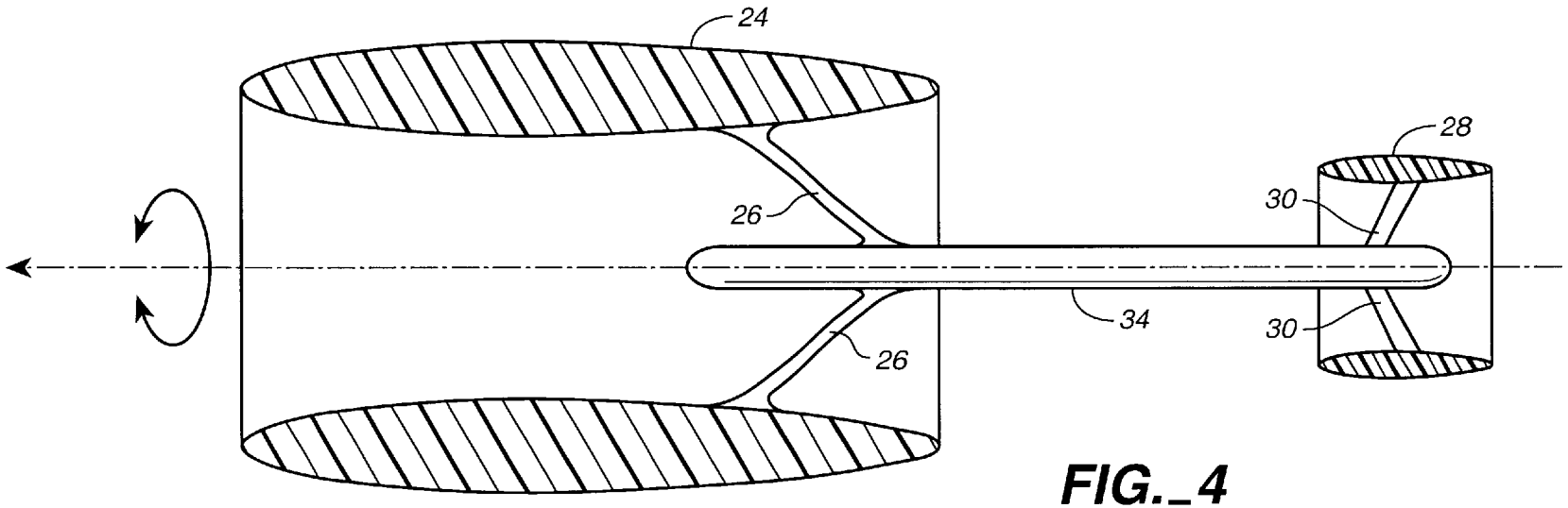
FIG. 4 is a sectional view of the configuration of FIG. 3 taken at A—A.

FIG. 4 shows a cross sectional view of the configuration of FIG. 3. If necessary, the struts or streamlined supports 30 shown in FIGS. 4 and 5 can be replaced by internal fins (e.g., 36, radiating outward along a radius line from the central axis) as shown in FIG. 6, so as to provide more stability in flight. The main ring wing 24 is composed of a foam rubber or spongy plastic and dimensioned such that it can be readily grasped and thrown like a football. The diameter of the rear or tail ring wing 28 (approximately 3") is smaller than the diameter of the main ring wing 24 (approximately 4") so that during the act of throwing there is no interference between the throwing hand and the toy during the toy's release. The main ring wing 24 is separated from the rear ring wing 28, by a center member length of approximately 4 inches, (separation distances can reasonably be as large as 10" and as small as a distance approximately equal to the diameter of the main ring wing).

Figure 5:
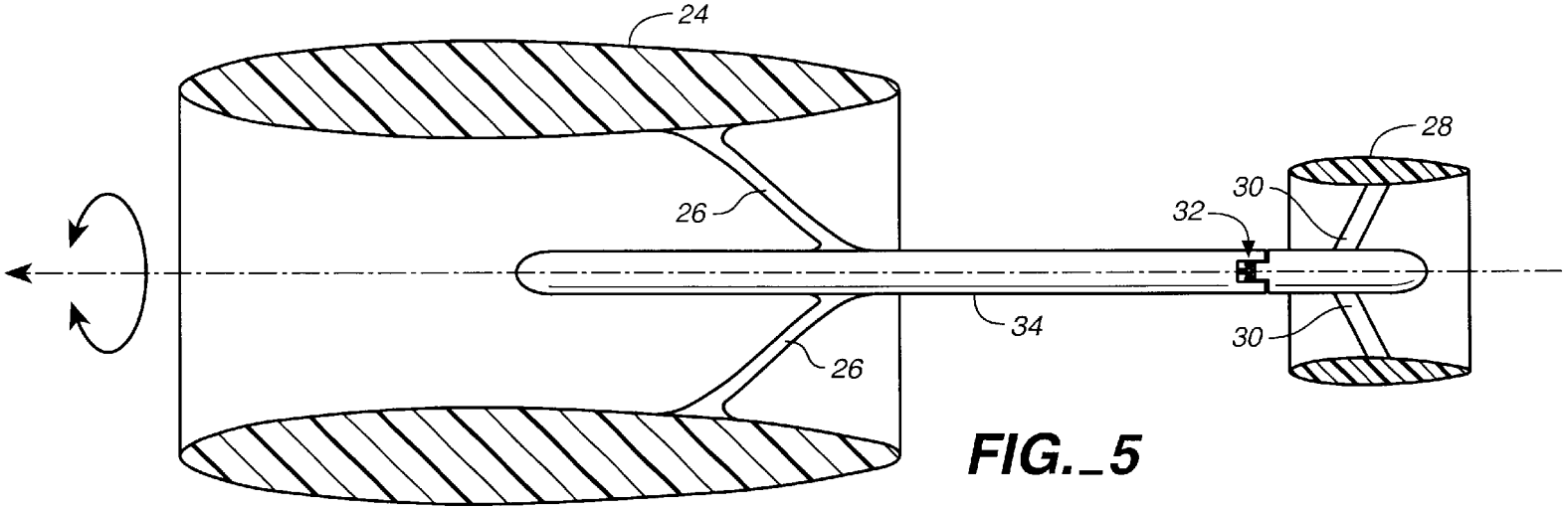
FIG. 5 is a sectional view of an alternate configuration according to the invention having a non-spinning ring-wing tail assembly.
Figure 7:
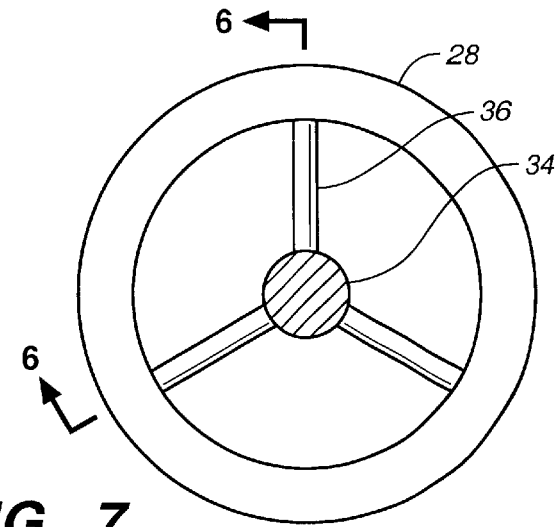
FIG. 7 is a sectional view of the tail design of FIG. 6 taken at B—B.
Figure 6:
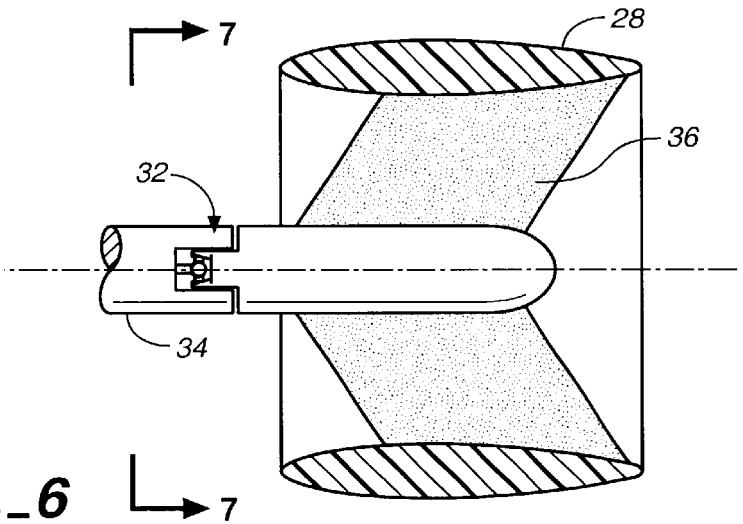
FIG. 6 is a sectional view of an alternate configuration of the ring-wing tail assembly in combination with tail fins.

The configuration shown in FIG. 5 is similar in overall design to the configuration shown in FIG. 4 except that the tail ring wing 28 is decoupled from any spin experienced by the main ring wing 24 by means of a bearing assembly (the location of which is shown inside the circle 32). The bearing assembly is located closer to the tail ring wing 28 than to the main ring wing 24. Improved flight stability results from decoupling the tail ring wing 28 from the main ring wing 24. The decoupling eliminates the dynamic response or rotational motion of the ring-wing tail 28 from influencing the overall motion of the entire unit so that there is minimum disturbance during the flight trajectory of the entire unit. In other words the use of a bearing assembly as shown in circle 32 or similar rotational connection, allows the entire unit to have excellent stability during the flight when thrown or launched by other means. Further, the high lift/low drag aerodynamic characteristics of the entire unit enables the unit when thrown or launched by other means to reach record distances.

FIG. 6 is a design variant of the tail assembly containing items 28 and 30 in FIGS. 3–5. Should it be necessary to increase the flight stability without a major increase in either the length of the center body (stem) 34 rearward and/or increasing the diameter of the tail ring wing 28, aerodynamically shaped fins 36 can replace the original struts 30, within the inner diameter of the ring-wing tail 28. The increased surface area of the fins 36 will greatly increase the stability in pitch and yaw thereby assisting in a more accurate flight path. The number size and area of the fins 36 located inside the tail ring wing 28 may be best determined by iterative testing. This methodology may also be used to obtain the optimal fin geometry (e.g., sweepback angle of the fins, their number, and area).

Figure 8:
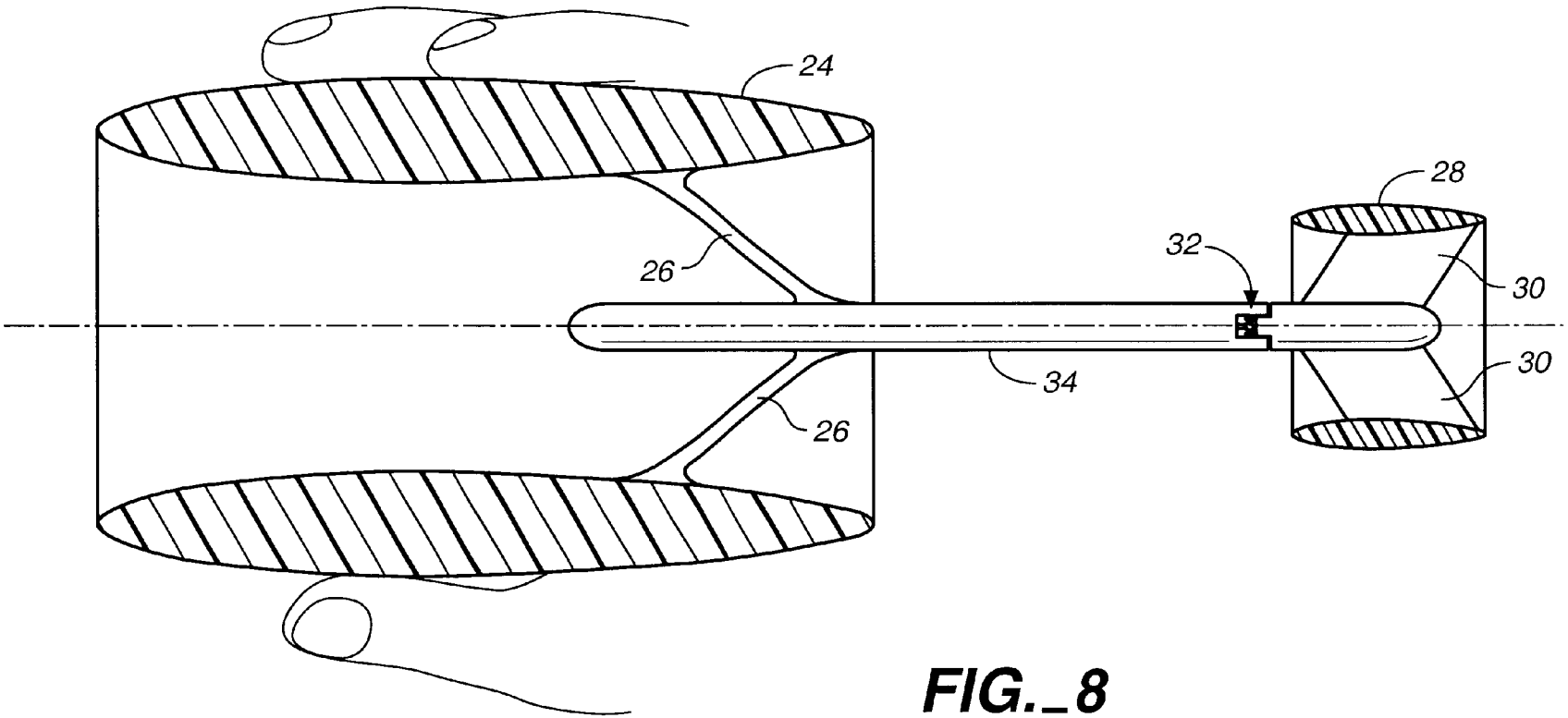
FIG. 8 is a partial cross-sectional cut-away view showing a hand gripping a configuration according to the invention, prior to throwing the device.

The exterior surface of the larger ring wing may also have a series of longitudinal grooves to aid gripping by a throwers fingers as shown in FIG. 8. Appropriate weights may be placed within the large ring wing to give the toy sufficient total weight and balance or by selecting materials depending on their density, to achieve a similar effect.

Figure 9:
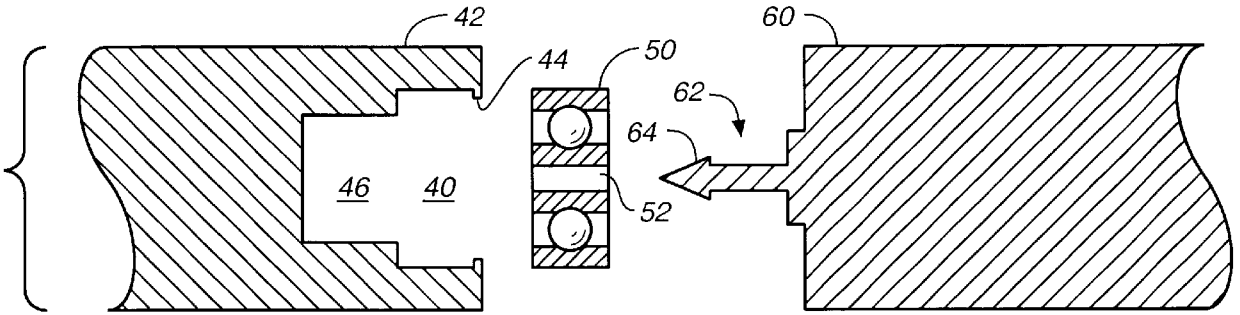
FIG. 9 is a close up exploded cross sectional view of an axial bearing connection for use in a configuration according to the invention.

FIG. 9 shows a cross sectional exploded arrangement of a stem (center body) bearing connection. Either end can be leading or following. The center body material is expected to be constructed of a stiff but not brittle plastic material. A bearing receiving cavity 40 exists in a first 42 of the members. The cavity 40 includes a bearing retaining lip 44 and a central void 46. When a bearing 50 is inserted the lip 44 expands and snaps down to hold the bearing 50 in place. A second piece 60, has a small central stem 62 with a barb shaped element 64 on its end that passes through a central passage (axis) 52 of the bearing 50 and snaps in to hold the second piece 60 in connection with the first piece 42. The first piece 42 can then rotate freely with respect to the second piece 60, but their axial positions are substantially fixed by the axial position snap fit.

Figure 10:
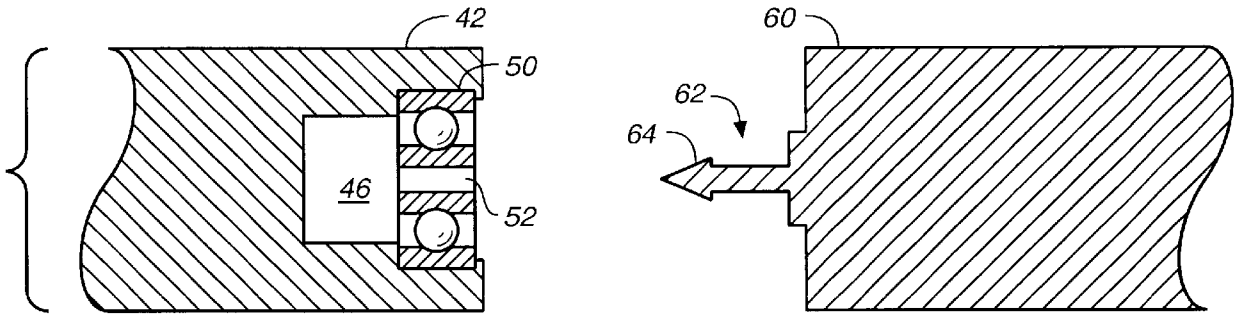
FIG. 10 is similar to FIG. 9, except that the axial bearing is positioned in a first part of the connecting rod.
Figure 11:
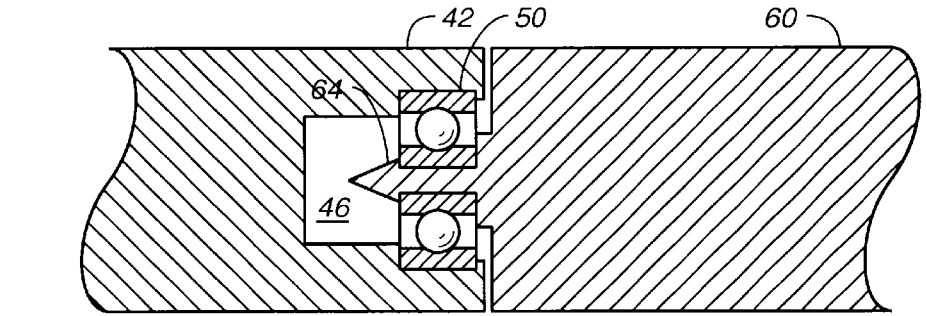
FIG. 11 is an assembled view of the items of FIG. 9.
Figure 12:
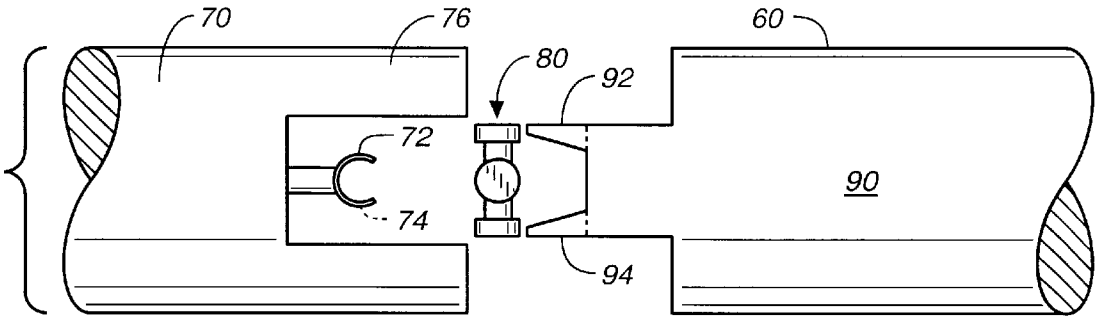
FIG. 12 is a close up exploded cross sectional view of a U-joint connection for use in a configuration according to the invention.
Figure 13:
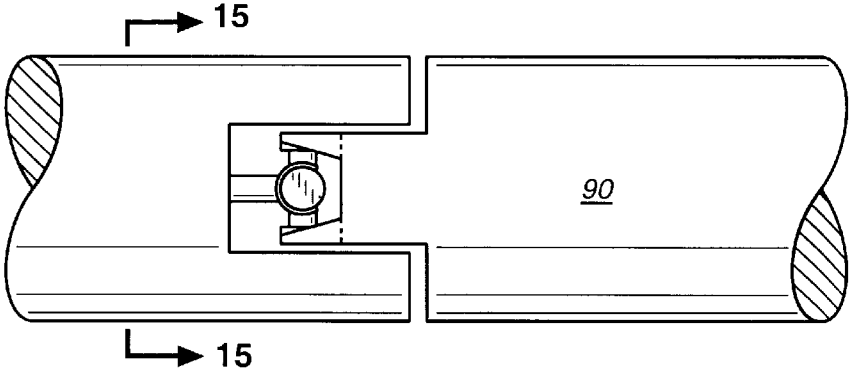
FIG. 13 is an assembled view of the items of FIG. 12.
Figure 14:
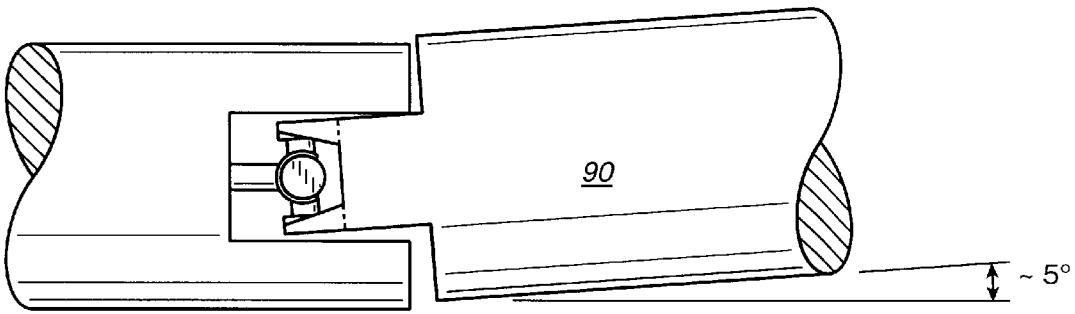
FIG. 14 shows the configuration of FIG. 13, but with a second end of the connecting rod offset by an angle through the U-joint connection.
Figure 15:
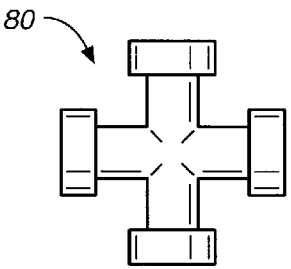
FIG. 15 shows a plan view of a U-joint of the type to be used in the configuration of FIGS. 12–14.

An alternate configuration which can be used together with or alone separate from the rotational bearing configuration shown in FIGS. 9–11, is a U-Joint connection configuration shown in FIGS. 12–14. A third end 70 (to distinguish its identification from the first and second ends pictured in FIGS. 9–11, though it could be one of those) can be connected to either the main or rear wing portions of the device. A U-joint cross 80, is snapped into two sets of clamping fingers 72, 74, and 92, 94 disposed at 90° to one another. An overhanging outside sleeve or skirt 76, prevents the third 70 and fourth 90 members from having a misalignment greater than approximately 5°, without hitting the skirt 76, which acts as a stop. The use of a U-joint connection can further enhance aerodynamic streamlining, by providing a mechanism by which dimensional variations introduced in manufacturing are negated. For example, if the main wing's central axis is not perfectly aligned with the rear wing's central axis, then additional drag is created due to the difference in the angle of attack between the two wings. In the instance when a U-joint connection is provided (either separately or in conjunction with the previously described bearing connection) the aerodynamic forces due to misalignment between the central axis of the two members will create a restoring force, which moves the U-joint to balance the aerodynamic forces to reduce the misalignment and associated drag, to create a longer flight.

The U-joint. connection and U-joint and bearing combination connection can also be used with a fin tail of the type shown for FIG. 1.

While the invention has been described with specific embodiments, those skilled in the art will recognize that changes can be made in form and detail without departing from the spirit and the scope of the invention.

I claim:

1. An aerial toy comprising:

two colinear ring wings connected to a central slender body through thin radial spokes, a forward ring wing of said two colinear ring wings being larger than a tail ring wing of said two colinear ring wings.

2. The aerial toy as in claim 1, wherein said tail ring wing connection with said central slender body is through a series of finned surface connection members.

3. The aerial toy as in claim 1, wherein said thin radial spokes connecting said tail ring wing to said central slender body are configured to be axially oriented aerodynamically shaped fins which extend radially outward from the central axis of the central slender body to said tail ring wing to stabilize non-rotating flight of said tail ring wing.

4. The aerial toy as in claim 3, wherein an axially rotating joint is positioned in said central slender body at a location between said forward ring wing and said tail ring wing.

5. The aerial toy as in claim 1, wherein a ratio of a diameter of said tail ring wing to a diameter of said forward ring wing is 0.8 or less.

6. The aerial toy as in claim 5, wherein a ratio of a diameter of said tail ring wing to a diameter of said forward ring wing is 0.75 or less.

7. The aerial toy as in claim 6, wherein a ratio of a diameter of said tail ring wing to a diameter of said forward ring wing is 0.6 or less.

8. The aerial toy as in claim 5, wherein a ratio of a diameter of said tail ring wing to a diameter of said forward ring wing is 0.5 or less.

9. The aerial toy as in claim 1, wherein a distance between a back end of said forward ring wing and a front edge of said tail ring wing is no greater than approximately 3 times the diameter of the forward ring wing.

10. The aerial toy as in claim 1, wherein a distance between a back end of said forward ring wing and a front edge of said tail ring wing is no greater than approximately 2 times the diameter of the forward ring wing.

11. The aerial toy as in claim 1, wherein a distance between a back end of said forward ring wing and a front edge of said tail ring wing is no greater than approximately 1.5 times the diameter of the forward ring wing.

12. The aerial toy as in claim 1, wherein central slender body includes a U-joint connection connecting a forward ring wing portion of said body to a tail ring wing portion of said body.

13. The aerial toy as in claim 12, wherein an axially rotating joint is positioned at one location in said central slender body, either at a first location in said forward ring portion of said body or a second location in said tail ring wing portion of said body.

14. The aerial toy as in claim 1, wherein said forward ring wing is configured to be graspable.

15. An aerial toy, comprising:

a ring wine connecting to a central slender body through thin radial spokes, said central slender body member being disposed at a central axis of said ring wing and having a central axis colinear with said central axis of said ring wing, wherein said central slender body member connects through a U-joint connection to a rear aerodynamic member.

16. The aerial toy as in claim 14, wherein said rear aerodynamic member is a series of fins connected to a rear portion of said central slender body member.

17. The aerial toy as in claim 15, wherein said rear aerodynamic member is a rear ring wing connected to a rear portion of said central slender body member.

18. The aerial toy as in claim 15, wherein the maximum range of angular deviation between member connected to said U-joint connection is set by the dimensions of a skin around said U-joint that prevents relative angular deviation beyond a set angle.

19. The aerial toy as in claim 15, wherein said ring wing is configured to be graspable.

* * * * *